US008004466B2

(12) United States Patent
Kim et al.

(10) Patent No.: US 8,004,466 B2
(45) Date of Patent: Aug. 23, 2011

(54) ANTENNA

(75) Inventors: Hyun Hak Kim, Gyunggi-do (KR); Jong Kweon Park, Daejeou (KR); Jung Nam Lee, Daejeon (KR); Seok Min Woo, Gyunggi-do (KR)

(73) Assignee: Samsung Electro-Mechanics Co., Ltd., Gyunngi-do (KR)

( * ) Notice: Subject to any disclaimer, the term of this patent is extended or adjusted under 35 U.S.C. 154(b) by 335 days.

(21) Appl. No.: 12/257,556

(22) Filed: Oct. 24, 2008

(65) Prior Publication Data

US 2009/0284419 A1 Nov. 19, 2009

(30) Foreign Application Priority Data

May 13, 2008 (KR) ..... 10-2008-0044110

(51) Int. Cl.
*H01Q 1/38* (2006.01)
*H01Q 1/48* (2006.01)

(52) U.S. Cl. ..... 343/700 MS; 343/846; 343/850

(58) Field of Classification Search ..... 343/343, 343/700 MS, 702, 907, 911 R, 767, 770, 343/846, 850

See application file for complete search history.

(56) References Cited

U.S. PATENT DOCUMENTS

| | | | | |
|---|---|---|---|---|
| 4,063,246 | A * | 12/1977 | Greiser | 343/700 MS |
| 5,327,148 | A * | 7/1994 | How et al. | 343/700 MS |
| 6,774,853 | B2 * | 8/2004 | Wong et al. | 343/700 MS |
| 6,992,637 | B2 * | 1/2006 | Hwang et al. | 343/770 |
| 7,116,276 | B2 * | 10/2006 | Lee | 343/700 MS |
| 7,183,979 | B1 * | 2/2007 | Liu et al. | 343/700 MS |
| 7,324,049 | B2 * | 1/2008 | Myoung et al. | 343/700 MS |
| 7,468,698 | B2 * | 12/2008 | Fujii et al. | 343/700 MS |
| 7,609,219 | B2 * | 10/2009 | Hashimoto | 343/767 |
| 2002/0180644 | A1 * | 12/2002 | Carson et al. | 343/700 MS |
| 2003/0058173 | A1 * | 3/2003 | Yoon | 343/702 |
| 2003/0189523 | A1 * | 10/2003 | Ojantakanen et al. | 343/702 |
| 2007/0279290 | A1 | 12/2007 | Shih | |

FOREIGN PATENT DOCUMENTS

| | | | |
|---|---|---|---|
| KR | 1020050117638 | A | 12/2005 |
| KR | 1020060089081 | A | 8/2006 |
| KR | 1020060095359 | A | 8/2006 |
| KR | 102070082457 | A | 8/2007 |

* cited by examiner

*Primary Examiner* — Hoang V Nguyen
(74) *Attorney, Agent, or Firm* — Lowe, Hauptman, Ham & Berner, LLP

(57) ABSTRACT

An antenna includes a dielectric substrate, a radiator disposed on one surface of the dielectric substrate, a feeding conductive pattern having one end connected with the radiator and the other end connected with an external feed line, a first slot disposed in the feeding conductive pattern, a ground plane disposed on the other surface of the dielectric substrate, and a second slot disposed on the ground plane.

20 Claims, 5 Drawing Sheets

ANTENNA

CROSS-REFERENCE TO RELATED APPLICATIONS

This application claims the priority of Korean Patent Application No. 2008-44110 filed on May 13, 2008, in the Korean Intellectual Property Office, the disclosure of which is incorporated herein by reference.

BACKGROUND OF THE INVENTION

1. Field of the Invention

The present invention relates to an antenna, and more particularly, to an antenna in which a radiator that transmits/receives a frequency signal of a predetermined band and a filter that can control a signal band of an operating frequency of the radiator are integrally formed.

2. Description of the Related Art

An ultra wide band (UWB) communication system is a radio technique that was first developed for military purposes in the 1960's by the U.S. Department of Defense. The UWB communication system is used at a low energy level by using a wide frequency band of 1 GHz to 100 GHz, and a transmission rate thereof reaches up to 500 Mbps to 1 Gbps which is about ten times higher than that of IEEE 802.11a (54 Mbps). The IEEE 802.11a is a set of standards for wireless local area network (WLAN) which is currently considered to have the highest transmission rate.

As to a UWB antenna, a UWB notch antenna has been recently developed, which notches a WLAN frequency band (5 GHz to 6 GHz) in order to avoid interference with the WLAN frequency band.

An antenna and a filter are manufactured as separate devices and are coupled together afterwards. However, for this reason, additional costs are caused for the antenna and the filter, impedance matching must be performed between components, and additional antennal tuning must be made due to changes in antenna characteristics such as reflection loss and group delay.

SUMMARY OF THE INVENTION

An aspect of the present invention provides an antenna including an integrally formed filter in order to achieve miniaturization, lightness and low manufacturing costs.

According to an aspect of the present invention, there is provided an antenna including: a dielectric substrate; a radiator disposed on one surface of the dielectric substrate; a feeding conductive pattern having one end connected with the radiator and the other end connected with an external feed line; a first slot disposed in the feeding conductive pattern; a ground plane disposed on the other surface of the dielectric substrate; and a second slot disposed in the ground plane.

The radiator may have an ultra wide band (UWB) frequency band characteristic.

The radiator may be a patch type radiator.

The first slot may separate the feeding conductive pattern into a plurality of portions.

The first slot may have a meander-line shape.

The second slot may overlap the feeding conductive pattern at least in part.

The second slot may be disposed at a location corresponding to a location at which the first slot is disposed.

The second slot may have a symmetrical shape.

A central line of the symmetrical shape of the second slot may face the feeding conductive pattern.

The second slot may have a dumbbell shape.

The antenna may further include a stub disposed between the radiator and the feeding conductive pattern.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
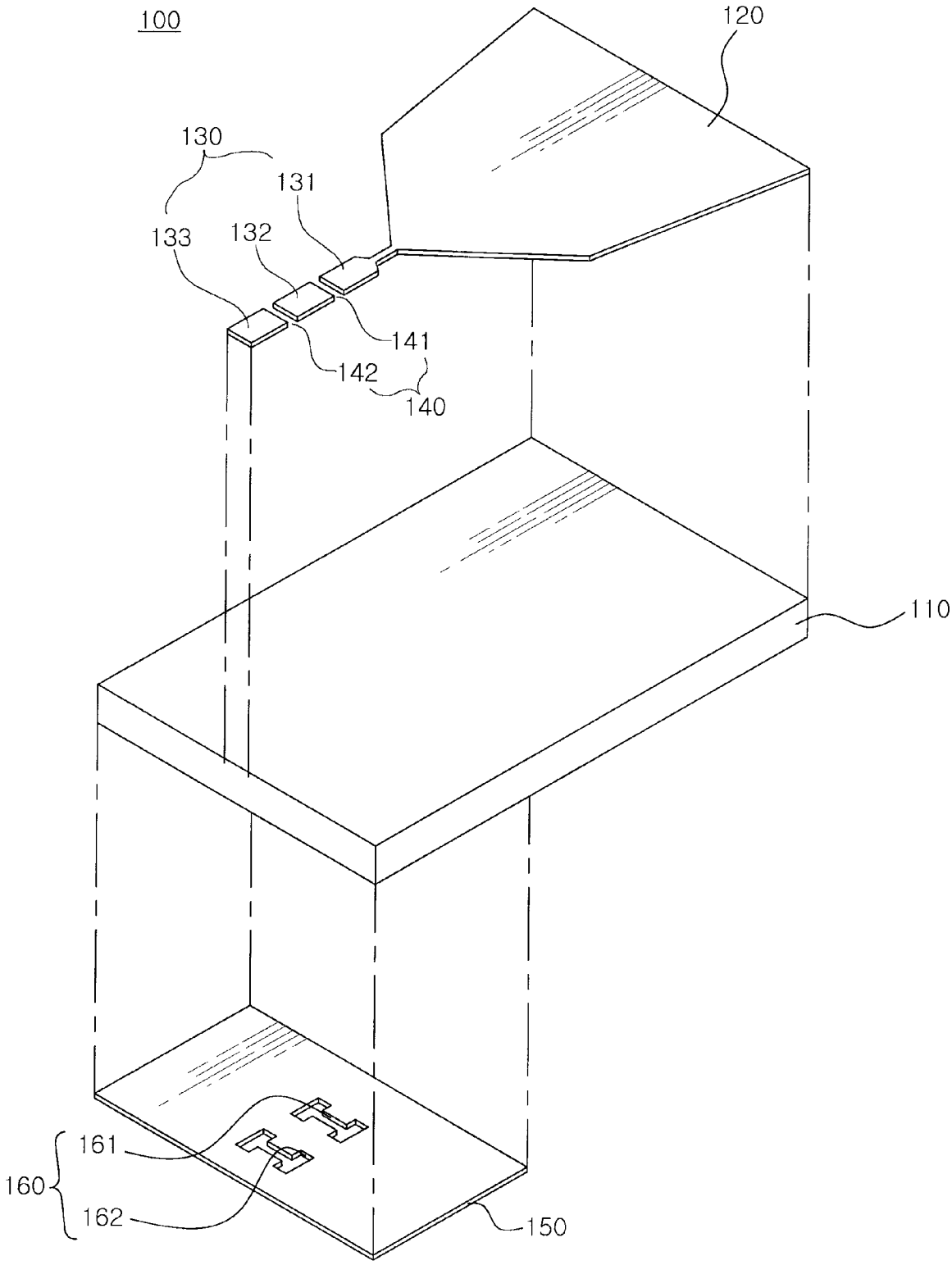
FIG. 1 is an exploded perspective view of an antenna according to an exemplary embodiment of the present invention.

FIG. 1 is an exploded perspective view of an antenna according to an exemplary embodiment of the present invention.

Referring to FIG. 1, an antenna 100 according to the current embodiment includes a dielectric substrate 110, a radiator 120, a feeding conductive pattern 130, a first slot 140, a ground plane 150, and a second slot 160.

The dielectric substrate 110 may have a predetermined dielectric constant. A micro-strip antenna may be provided by the dielectric substrate 110 having the dielectric constant, the feeding conductive pattern 130 and the radiator 120 disposed on one surface of the dielectric substrate 110, and the ground plane 150 disposed on the other surface of the dielectric substrate 110. According to the current embodiment, the dielectric substrate 110 may include FR-4.

The radiator 120 may receive/transmit a predetermined frequency band signal. According to the current embodiment, the radiator 120 may be a patch type, which can transmit/receive an ultra-wide-band (UWB) frequency signal. The patch-type radiator 120 may be variously implemented. According to the current embodiment, the radiator 120 may have a modified trapezoid shape. The radiator 120 may be tapered downwards.

The feeding conductive pattern 130 may have one end connected to an external feed line and the other end connected to the radiator 120. The feeding conductive pattern 130 may have a resistance of about 50 ohm. The resistance within the feeding conductive pattern 130 may be controlled according to an area and a width of the feeding conductive pattern 130.

The feeding conductive pattern 130 may be formed at a central portion of one area of the dielectric substrate 110.

According to the current embodiment of the present invention, the feeding conductive pattern 130 may be placed at a central portion of one surface of the dielectric substrate 110 having a rectangular shape.

The first slot 140 may be provided in the feeding conductive pattern 130. The first slot 140 may separate the feeding conductive pattern 130 into different portions. According to the current embodiment, the first slot 140 may include two first slots 141 and 142, and thus the feeding conductive pattern 130 may be separated into three conductive patterns 131, 132 and 133.

The first slot 140 in the feeding conductive pattern 130 may form an inductance component and a capacitance component at the feeding conductive pattern 130. That is, capacitance components may be formed between the feeding conductive patterns 131, 132 and 133 separated by the first slot 140 by electromagnetic coupling between the separated feeding conductive patterns 131, 132 and 133. The inductance components may be formed by a current flowing through the feeding conductive pattern 130. Because of the capacitance and inductance components, the feeding conductive pattern 130 may serve as a filter that passes only a signal of a predetermined frequency band. According to the current embodiment, the first slot 140 may allow the feeding conductive pattern 130 to serve as a high pass filter (HPF) with respect to a frequency signal received/transmitted through the radiator 120. The first slot 140 may be varied in shape and number according to the required capacitance component and inductance component.

The ground plane 150 may be formed on the other surface of the dielectric substrate 110.

The ground plane 150 may be connected to an external ground line to serve as the ground of the antenna. The ground plane 150 may constitute a microstrip antenna by the electromagnetic coupling with the feeding conductive pattern 130 and the radiator 120 provided on one surface of the dielectric substrate 110.

The second slot 160 may be provided in the ground plane 150.

The second slot 160 may partially overlap the feeding conductive pattern 130 disposed on one surface of the dielectric substrate 110. According to the current embodiment, the second slot 160 may include two second slots 161 and 162 respectively facing the first slots 141 and 142 disposed on the feeding conductive pattern 130.

According to the current embodiment, each of the second slots 161 and 162 may be symmetrical about the feeding conductive pattern 130. A central line of each of the symmetrical second slots 161 and 162 may be placed to face the feeding conductive pattern 130. The second slot 160 may be provided in the form of a dumbbell. A shape of the dumbbell may be variously implemented.

The second slot 160 may have various shapes. The second slot 160 may form an inductance component and a capacitance component in the ground plane 150. Due to the inductance component and the capacitance component, the ground plane 150 may serve as a low pass filter (LPF) with respect to a frequency signal transmitted/received through the radiator 120.

Figure 2A:
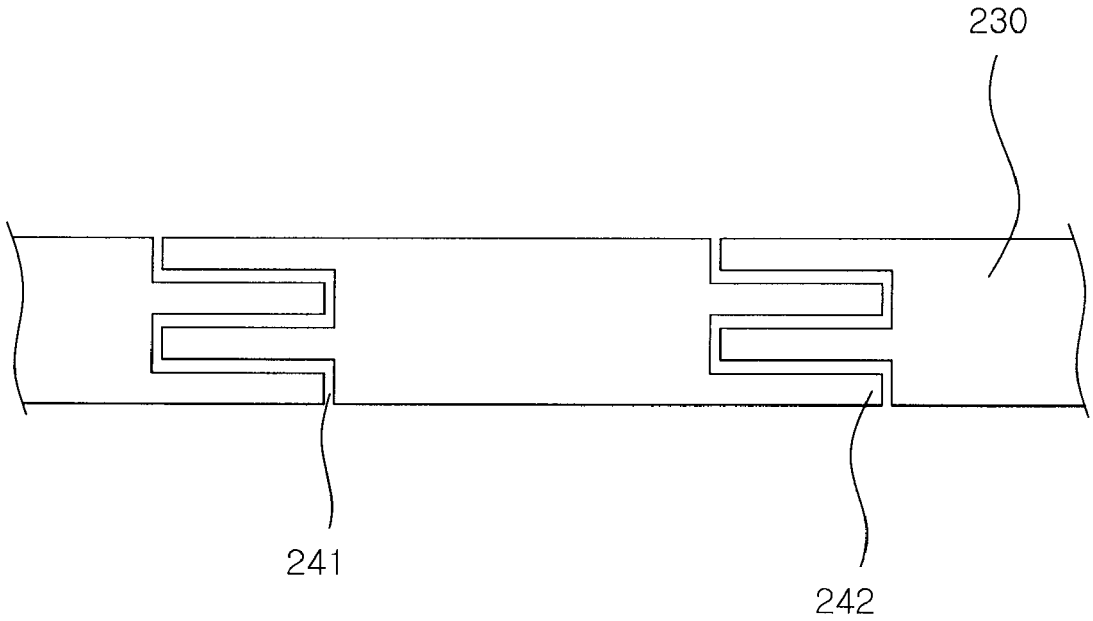
FIG. 2A is a view of a first slot formed in a feeding conductive line, according to an exemplary embodiment of the present invention.
Figure 2B:
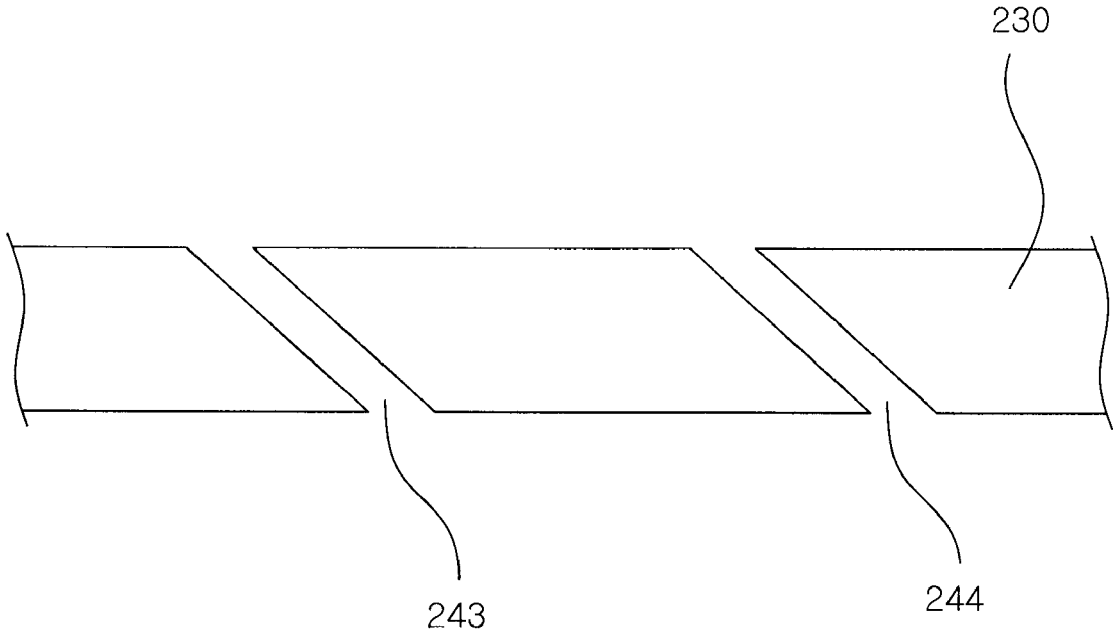
FIG. 2B is a view of a first slot formed in a feeding conductive line, according to another exemplary embodiment of the present invention.

FIGS. 2A and 2B are views of a first slot formed in a feeding conductive line, according to exemplary embodiments of the present invention.

According to the exemplary embodiment of FIG. 2A, two first slots 241 and 242 each provided in the form of a meander line may be provided in a feeding conductive line 230. As the first slots 241 and 242 are provided in the form of a meander line, a facing area between feeding conductive lines separated by a corresponding one of the first slots 241 and 242 increases. Thus, a capacitance component can be increased.

According to the exemplary embodiment of FIG. 2B, two first slots 243 and 244 each having an oblique-line shape may be provided in the feeding conductive line 230. The oblique shape of the first slots 243 and 244 may reduce the capacitance component and be formed using a simpler method as compared to the first slots 243 and 244 in the form of a meander-line.

Figure 3:
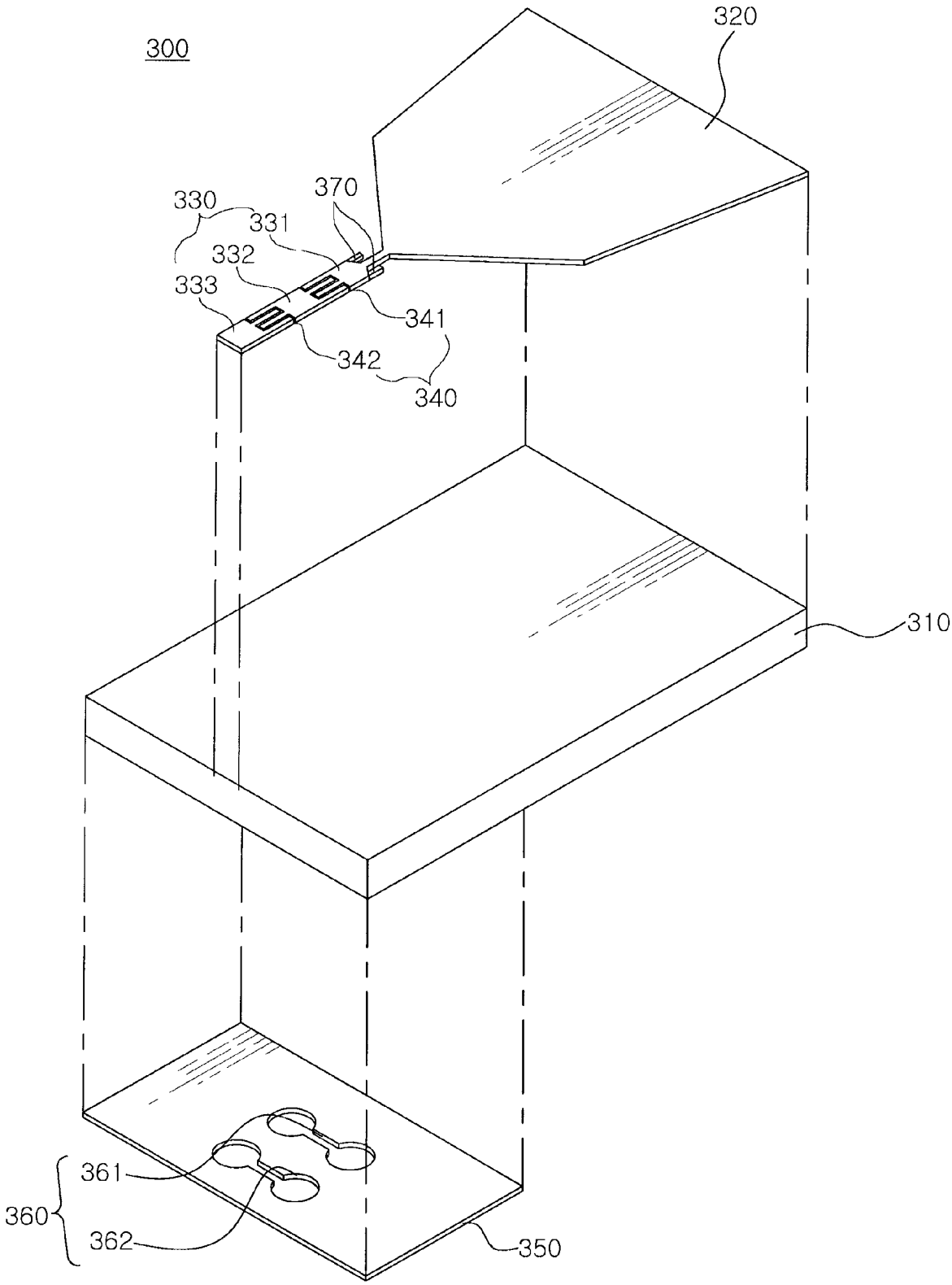
FIG. 3 is an exploded perspective view of an antenna according to another exemplary embodiment of the present invention.

FIG. 3 is an exploded perspective view of an antenna according to another exemplary embodiment of the present invention.

Referring to FIG. 3, an antenna 300 according to the current embodiment includes a dielectric substrate 310, a radiator 320, a feeding conductive pattern 330, a first slot 340, a ground plane 350, a second slot 360, and a stub 370.

The dielectric substrate 310 may have a predetermined dielectric constant. A microstrip antenna may be provided by the dielectric substrate 310 having the dielectric constant, the feeding conductive pattern 330 and the radiator 320 disposed on one surface of the dielectric substrate 310, and the ground plane 350 disposed on the other surface of the dielectric substrate 310. According to the current embodiment, the dielectric substrate 310 may include FR-4.

The radiator 320 may transmit/receive a predetermined frequency band signal. According to the current embodiment, the radiator 320 may be a patch type, which can transmit/receive a UWB frequency signal. The patch-type radiator 320 may be variously implemented. According to the current embodiment, the radiator 320 may have a modified trapezoid shape. The radiator 320 may be tapered downwards.

The feeding conductive pattern 330 may have one end connected to an external feed line and the other end connected to the radiator 320. The feeding conductive pattern 330 may have a resistance of about 50 ohm. The resistance within the feeding conductive pattern 330 may be controlled according to an area and a width of the feeding conductive pattern 330.

The feeding conductive pattern 330 may be formed at a central portion of one area of the dielectric substrate 310. According to the current embodiment of the present invention, the feeding conductive pattern 330 may be placed at a central portion of one surface of the dielectric substrate 310 having a rectangular shape.

The stub 370 may be provided at a portion where the feeding conductive pattern 330 and the radiator 320 are connected together.

The stub 370 may serve to match impedance between the feeding conductive pattern 330 and the radiator 320. That is, the stub 370 reduces reflection of a feed signal being fed to the radiator 320 through the feeding conductive pattern 330, thereby improving feed efficiency. According to the current embodiment, a pair of stubs that are symmetrical to each other may be provided. The stub 370 may be variously implemented.

The first slot 340 may be disposed in the feeding conductive pattern 330. The first slot 340 may separate the feeding conductive pattern 330 into different portions. According to the current embodiment, the first slot 340 may include two first slots 341 and 342 and thus the feeding conductive pattern 330 may be separated into three conductive patterns 331, 332 and 333. According to the current embodiment, each of the first slots 341 and 342 may provided in the form of a meander-line. The first slot 340 may be varied in number according to a desired passband.

The first slot 340 in the feeding conductive pattern 330 may form an inductance component and a capacitance component in the feeding conductive pattern 330. That is, a capacitance component may be formed between the feeding conductive patterns 331, 332 and 333 separated by the first slot 340 by the electromagnetic coupling between the separated feeding conductive patterns 331, 332 and 333. According to the current embodiment, since the first slot 340 has the meander-line form, a capacitance component between the separated feeding conductive patterns 331, 332 and 333 can be further increased. Also, an inductance component may be formed by the current flowing through the feeding conductive pattern 330. Because of the capacitance component and the inductance component, the feeding conductive pattern 330 may serve as a filter that passes only a signal of a predetermined frequency band. According to the current embodiment, the first slot 340 may allow the feeding conductive pattern 330 to serve as an HPF with respect to a frequency signal transmitted/received through the radiator 320.

The ground plane 350 may be disposed on the other surface of the dielectric substrate 310.

The ground plane 350 may be connected to an external ground line to serve as the ground of the antenna. The ground plane 350 may constitute a microstrip antenna by the electromagnetic coupling with the feeding conductive pattern 330 and the radiator 320 disposed on one surface of the dielectric substrate 310.

The second slot 360 may be disposed in the ground plane 350.

The second slot 360 may partially overlap the feeding conductive pattern 330 disposed on one surface of the dielectric substrate 310. According to the current embodiment, the second slots 361 and 362 may respectively face the first slots 341 and 342 disposed on the feeding conductive pattern 330.

According to the current embodiment, each of the second slots 361 and 362 may have a symmetrical shape, and a central line of each of the symmetrical second slots 361 and 362 may be formed at a location corresponding to the feeding conductive pattern 330. Each of the second slots 361 and 362 may be provided in the form of a dumbbell. A shape of the dumbbell may be variously implemented.

The second slot 360 may have various shapes. An inductance component and a capacitance component may be formed in the ground plane because of the second slot 360. The inductance component and the capacitance component allow the ground plane 350 to serve as a low pass filter (LPF) with respect to a frequency signal transmitted/received through the radiator 320.

Figure 4:
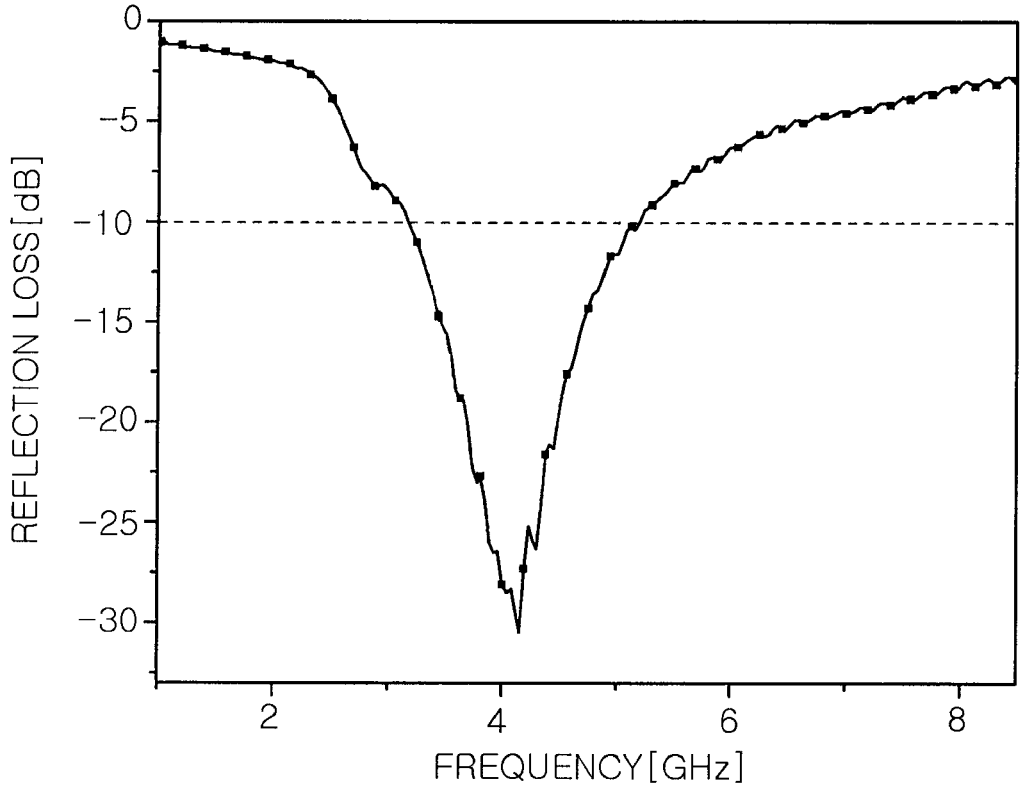
FIG. 4 is a graph of reflection loss of the antenna of FIG. 3.

FIG. 4 is a graph showing reflection loss of the antenna of FIG. 3.

It can be seen from FIG. 4 that the antenna according to the current embodiment operates only for a frequency signal of about 3.1 GHz to about 5.2 GHz of a UWB frequency signal. In the case where just a radiator having the UWB characteristic is used, the antenna may operate for the entire UWB signal. However, the antenna including an integrally formed filter according to the current embodiment has a bandpass characteristic and thus can operate only within a desired band in a UWB.

Figure 5:
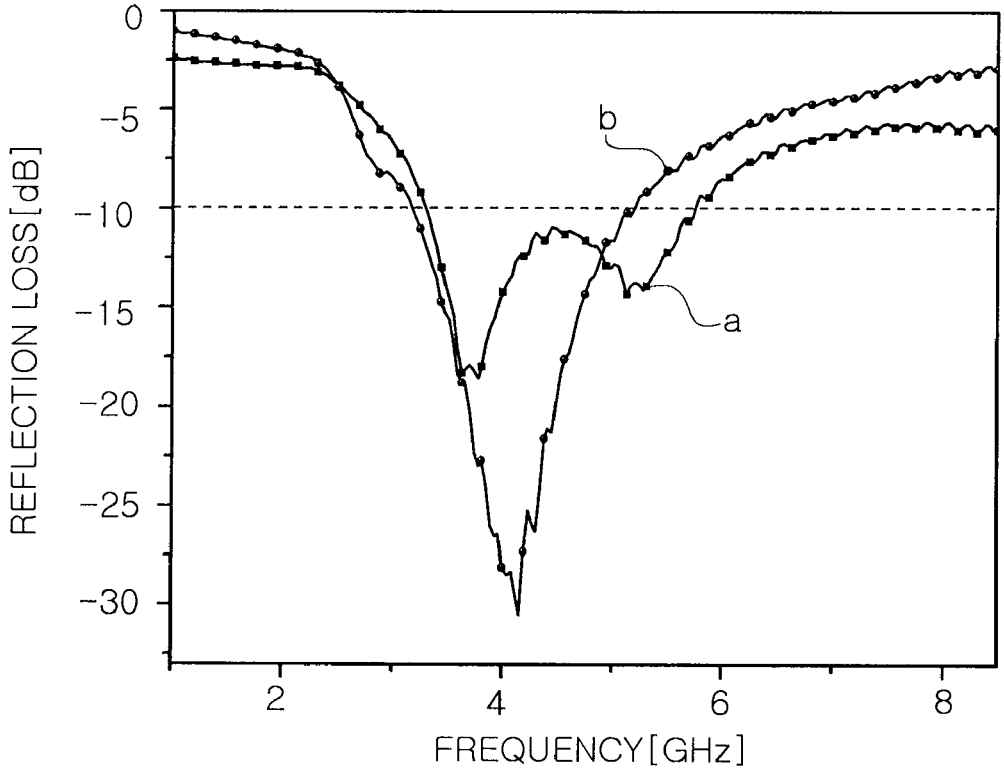
FIG. 5 is a graph of reflection loss depending on the presence of a stub in the antenna of FIG. 3.

FIG. 5 is a graph of reflection loss depending on the presence of a stub in the antenna of FIG. 3.

In FIG. 5, curve 'a' indicates the reflection loss when a stub is not present in the antenna, and curve 'b' indicates the reflection loss when a stub is present in the antenna. It can be seen from FIG. 5 that when the stub is not present, the reflection-loss is skewed toward a higher frequency and matching in a passband is degraded. Accordingly, impedance matching is improved by forming a stub between the feeding conductive pattern and the radiator according to the current embodiment, so that antenna efficiency can be improved.

Figure 6:
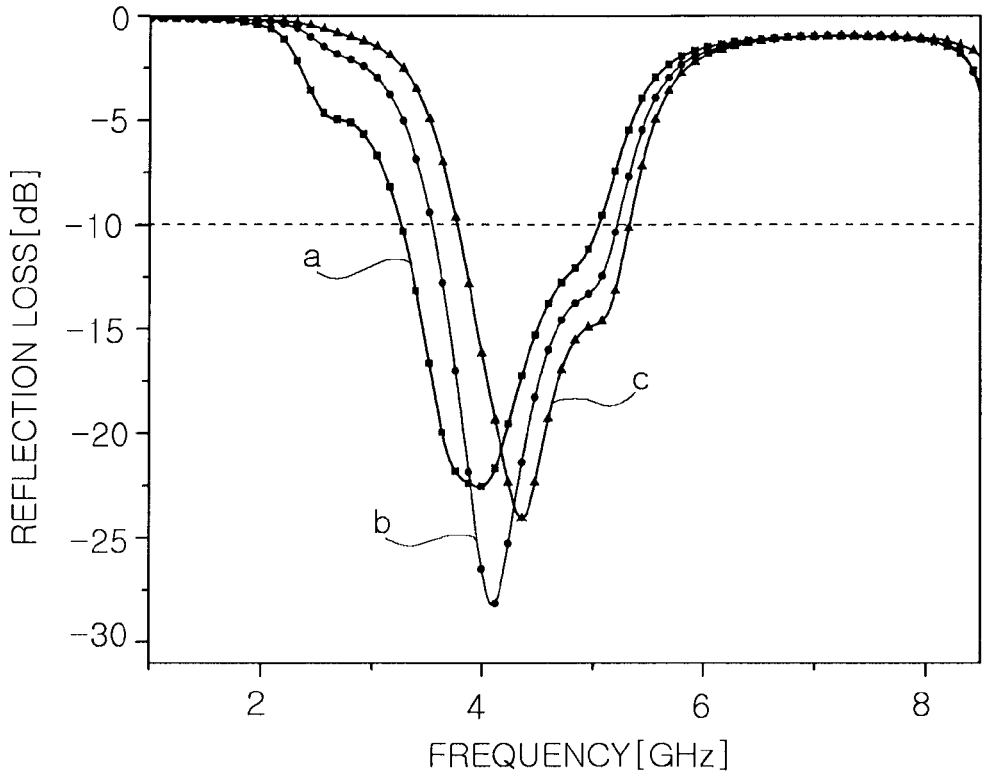
FIG. 6 is a graph of reflection loss depending on an interval between first slots in the antenna of FIG. 3.

FIG. 6 is a graph of reflection loss depending on an interval between first slots in the antenna of FIG. 3.

In FIG. 6, curve 'a' indicates the reflection loss when an interval between first slots is 0.1 mm, curve 'b' indicates the reflection loss when an interval between first slots is 0.2 mm, and curve 'c' indicates the reflection loss when an interval between first slots is 0.3 mm. That is, it can be seen that the reflection loss is skewed toward a higher frequency as the interval between the first slots becomes wider.

Accordingly, a pass characteristic of a desired frequency band can be obtained by controlling an interval between the first slots as well as a length of the first slots.

Figure 7:
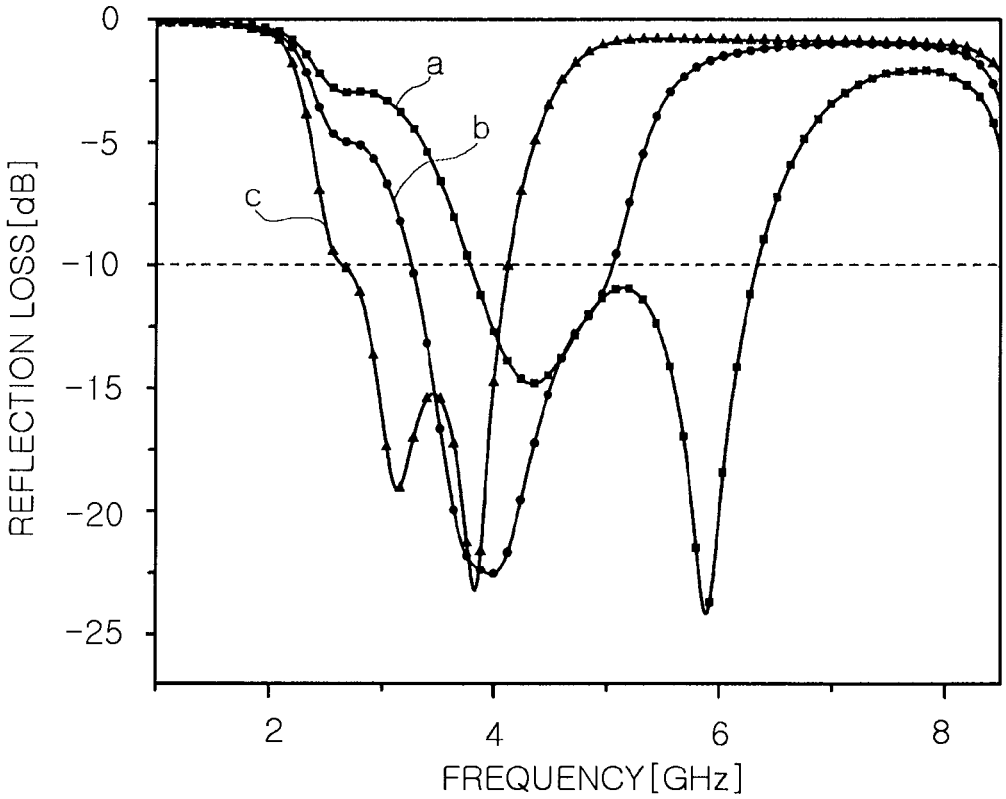
FIG. 7 is a graph of reflection loss depending on a size of a second slot in the antenna of FIG. 3.

FIG. 7 is a graph of reflection loss depending on the size of a second slot in the antenna of FIG. 3.

It can be seen from FIG. 7 that the reflection loss is skewed toward a lower frequency and a bandwidth is reduced as the size of the second slot becomes greater. Accordingly, a desired frequency pass characteristic can be obtained by controlling the second slot.

According to the exemplary embodiments of the present invention, an antenna including an integrally formed filter can be obtained, so that miniaturization, lightness and low manufacturing costs of the antenna can be achieved.

While the present invention has been shown and described in connection with the exemplary embodiments, it will be apparent to those skilled in the art that modifications and variations can be made without departing from the spirit and scope of the invention as defined by the appended claims.

What is claimed is:

1. An antenna comprising:

a dielectric substrate;

a radiator disposed on a first surface of the dielectric substrate;

a feeding conductive pattern having a first end connected with the radiator and a second end configured to be connected with an external feed line;

a first slot formed in the feeding conductive pattern;

a ground plane disposed on a second surface of the dielectric substrate; and a second slot formed in and enclosed within the ground plane.

2. The antenna of claim 1, wherein the radiator has an ultra wide band (UWB) frequency band characteristic.

3. The antenna of claim 2, wherein the radiator is a patch type radiator.

4. The antenna of claim 1, wherein the first slot is formed to physically separate the feeding conductive pattern into a plurality of portions along a longitudinal direction of the feeding conductive pattern.

5. The antenna of claim 1, wherein the second slot overlaps the feeding conductive pattern at least in part.

6. The antenna of claim 5, wherein the second slot is disposed at a location on the second surface corresponding to a location on the first surface at which the first slot is formed.

7. The antenna of claim 5, wherein the second slot has a symmetrical shape.

8. The antenna of claim 7, wherein a central line of the symmetrical shape of the second slot faces the feeding conductive pattern.

9. The antenna of claim 1, wherein the second slot has a dumbbell shape.

10. The antenna of claim 1, further comprising a third slot formed in the feeding conductive pattern.

11. The antenna of claim 10, further comprising a fourth slot formed in and enclosed within the ground plane.

12. An antenna comprising:

a dielectric substrate;

a radiator disposed on a first surface of the dielectric substrate;

a feeding conductive pattern having a first end connected with the radiator and a second end configured to be connected with an external feed line;

a first slot formed in the feeding conductive pattern;

a ground plane disposed on a second surface of the dielectric substrate; and a second slot formed in and enclosed within the ground plane, wherein the first slot has a meander line shape and is formed to physically separate the feeding conductive pattern into a plurality of portions along a longitudinal direction of the feeding conductive pattern.

13. The antenna of claim 12, further comprising a third slot formed in the feeding conductive pattern.

14. The antenna of claim 13, further comprising a fourth slot formed in and enclosed within the ground plane.

15. An antenna comprising:

a dielectric substrate;

a radiator disposed on a first surface of the dielectric substrate;

a feeding conductive pattern having a first end connected with the radiator and a second end configured to be connected with an external feed line;

a first slot formed in the feeding conductive pattern;

a ground plane disposed on a second surface of the dielectric substrate;

a second slot formed in and enclosed within the ground plane; and a stub formed on the feeding conductive pattern and extending from the first end toward the radiator.

16. The antenna of claim 15, further comprising a third slot formed in the feeding conductive pattern.

17. The antenna of claim 16, further comprising a fourth slot formed in and enclosed within the ground plane.

18. An antenna comprising:

a dielectric substrate;

a radiator disposed on a first surface of the dielectric substrate;

a feeding conductive pattern having a first end connected with the radiator and a second end configured to be connected with an external feed line;

a first slot formed in the feeding conductive pattern;

a ground plane disposed on a second surface of the dielectric substrate;

a second slot formed in and enclosed within the ground plane; and a stub formed on the feeding conductive pattern and extending from the first end toward the radiator, wherein the first slot has a meander line shape and is formed to physically separate the feeding conductive pattern into a plurality of portions along a longitudinal direction of the feeding conductive pattern.

19. The antenna of claim 18, further comprising a third slot formed in the feeding conductive pattern.

20. The antenna of claim 18, further comprising a fourth slot formed in and enclosed within the ground plane.

* * * * *